US009175550B2

(12) United States Patent
Dunlavy

(10) Patent No.: US 9,175,550 B2
(45) Date of Patent: Nov. 3, 2015

(54) CONTAINMENT CELLAR

(75) Inventor: Christopher L. Dunlavy, Williston, ND (US)

(73) Assignee: C & C Rentals, LLC, Williston, ND (US)

( * ) Notice: Subject to any disclaimer, the term of this patent is extended or adjusted under 35 U.S.C. 154(b) by 527 days.

(21) Appl. No.: 13/452,352

(22) Filed: Apr. 20, 2012

(65) Prior Publication Data

US 2013/0277056 A1 Oct. 24, 2013

(51) Int. Cl.
*E21B 21/01* (2006.01)
*E21B 43/01* (2006.01)

(52) U.S. Cl.
CPC ..... *E21B 43/0122* (2013.01)

(58) Field of Classification Search
CPC ..... B65G 5/00; F17C 3/005
USPC ..... 166/306, 51, 54.1, 68, 81.1; 405/52, 53
See application file for complete search history.

(56) References Cited

U.S. PATENT DOCUMENTS

| | | | | | |
|---|---|---|---|---|---|
| 1,381,669 | A | * | 6/1921 | Schreiber | 165/142 |
| 2,111,439 | A | * | 3/1938 | Squyars | 222/609 |
| 2,786,651 | A | * | 3/1957 | Mickle | 175/206 |
| 4,643,259 | A | | 2/1987 | Zeringue, Jr. | |
| 5,098,220 | A | * | 3/1992 | Norman | 405/52 |
| 5,244,569 | A | * | 9/1993 | Di Amico | 210/163 |
| 5,477,920 | A | * | 12/1995 | Simmons | 166/81.1 |
| 7,637,692 | B1 | * | 12/2009 | Rose | 405/52 |
| 2005/0051480 | A1 | | 3/2005 | Newman | |
| 2011/0114389 | A1 | | 5/2011 | Mathena | |

* cited by examiner

*Primary Examiner* — Cathleen Hutchins
*Assistant Examiner* — Ronald Runyan
(74) *Attorney, Agent, or Firm* — Marsh Fischmann & Breyfogle LLP; Jonathon A. Szumny

(57) ABSTRACT

A containment cellar collects petroleum products leaked in a vicinity of a conductor pipe at an oil drilling site. The containment cellar has a body, a pipe, and a pumping orifice. The body has bottom and side surfaces to define an interior chamber to surround a length of the conductor pipe. The bottom surface includes an aperture to receive the conductor pipe. The surfaces are composed of materials substantially impermeable to the petroleum products. The side surface has sufficient strength to maintain integrity of the interior chamber when the containment cellar is disposed at least partially beneath a surface of the earth. The pipe extends through the interior chamber. The pumping orifice is coupled with the pipe and adapted for coupling with a pump to extract the leaked petroleum products from the interior chamber.

13 Claims, 4 Drawing Sheets

CONTAINMENT CELLAR

BACKGROUND OF THE INVENTION

This application relates generally to oil drilling and production. More specifically, this application relates to containment of leaks during oil drilling, production, and completion processes.

There are a number of different types of structures that are used in oil drilling, but there are certain common features. For example, a common approach is to drill a borehole (typically between 5 and 50 inches in diameter) into the earth with a drilling rig that rotates a drill string with a bit attached. Casing sections of steel pipe having a diameter smaller than the borehole are place into the borehole, and cement may be used between the outside of the casing and the borehole itself. This casing provides structural integrity to the borehole and may also isolate potentially dangerous high-pressure zones from each other and from the surface. It is common to drill deeper by using a sequence of smaller bits with progressively smaller casings.

The cased borehole is completed by making perforations in the portion of the casing in the oil-production zone, thereby providing a path for the oil to flow from the surrounding rock into production tubing. Other structures such as sand screens or gravel packs may additionally be used, as known to those of skill in the art. While many sites have sufficient natural pressure in the subsurface reservoir for the oil to flow to the surface, other sites require the use of additional structures such as downhole pumps, gas lifts, or surface pump jacks.

One of the risks involved with these techniques for oil production is the potential for structures to leak. Natural pressures on the structures, both underground and aboveground, can cause damage. Over time, even small leaks can result in the escape of considerable amounts of oil that not only affects production volume but may also cause damage to the local environment by producing pools of leaked oil.

Traditional methods for addressing this potential for leaks have made use of concrete culvert pipes, but there are a number of long-term costs and safety issues associated with such methods. For example, difficulties with culvert pipes include the potential for soil and groundwater contamination and present a difficult work environment for onsite workers.

There is accordingly a need in the art for methods and systems that prevent the escape of leaked oil in oil-production processes.

SUMMARY

Embodiments of the invention provide a containment cellar for collecting petroleum products leaked in a vicinity of a conductor pipe at an oil drilling site. The containment cellar comprises a body, a pipe, and a pumping orifice. The body comprises a bottom surface and a side surface to define an interior chamber to surround a length of the conductor pipe. The bottom surface includes an aperture to receive the conductor pipe. The bottom and side surfaces are composed of materials substantially impermeable to the petroleum products. The side surface is composed of a material having sufficient strength to maintain integrity of the interior chamber when the containment cellar is disposed at least partially beneath a surface of the earth. The pipe extends from a location proximate the bottom surface through the interior chamber to a top of the interior chamber. The pumping orifice is coupled with the pipe at the top of the interior chamber and adapted for coupling with a pump to extract the leaked petroleum products from the interior chamber.

In some embodiments, the containment cellar further comprises a grating disposed at the top of the interior chamber opposite the bottom surface. The bottom surface may sometimes comprise a well, with the location proximate the bottom surface being proximate the well. In a particular embodiment, the pumping orifice comprises a plurality of pumping orifices, the well comprises a plurality of wells, and the pipe comprises a plurality of pipes. Each of the plurality of pipes is coupled with a respective one of the plurality of pumping orifices and extends from a location proximate a respective one of the wells through the interior chamber to the top of the interior chamber.

In some instances, a reinforcing member may be disposed within the interior chamber. The bottom and side surfaces may be made of metal, Plexiglas, or hard plastic, among other materials. In some instances, the side surface comprises a plurality of side surfaces joined such that the interior chamber has a polygonal cross section. The bottom surface may also comprise a plurality of pieces, joined with a material substantially impermeable to the petroleum products between the pieces.

The containment cellar described above may be used in methods for collecting petroleum products leaked in the vicinity of a conductor pipe at an oil drilling site. The containment cellar is disposed at least partially beneath a surface of the earth, the petroleum products are collected in the interior chamber, and the collected petroleum products are pumped from the interior chamber.

BRIEF DESCRIPTION OF THE DRAWINGS

A further understanding of the nature and advantages of the present invention may be realized by reference to the remaining portions of the specification and the drawings, wherein like reference labels are used through the several drawings to refer to similar components. In some instances, reference labels are followed with a hyphenated sublabel; reference to only the primary portion of the label is intended to refer collectively to all reference labels that have the same primary label but different sublabels.

DETAILED DESCRIPTION

Figure 1:
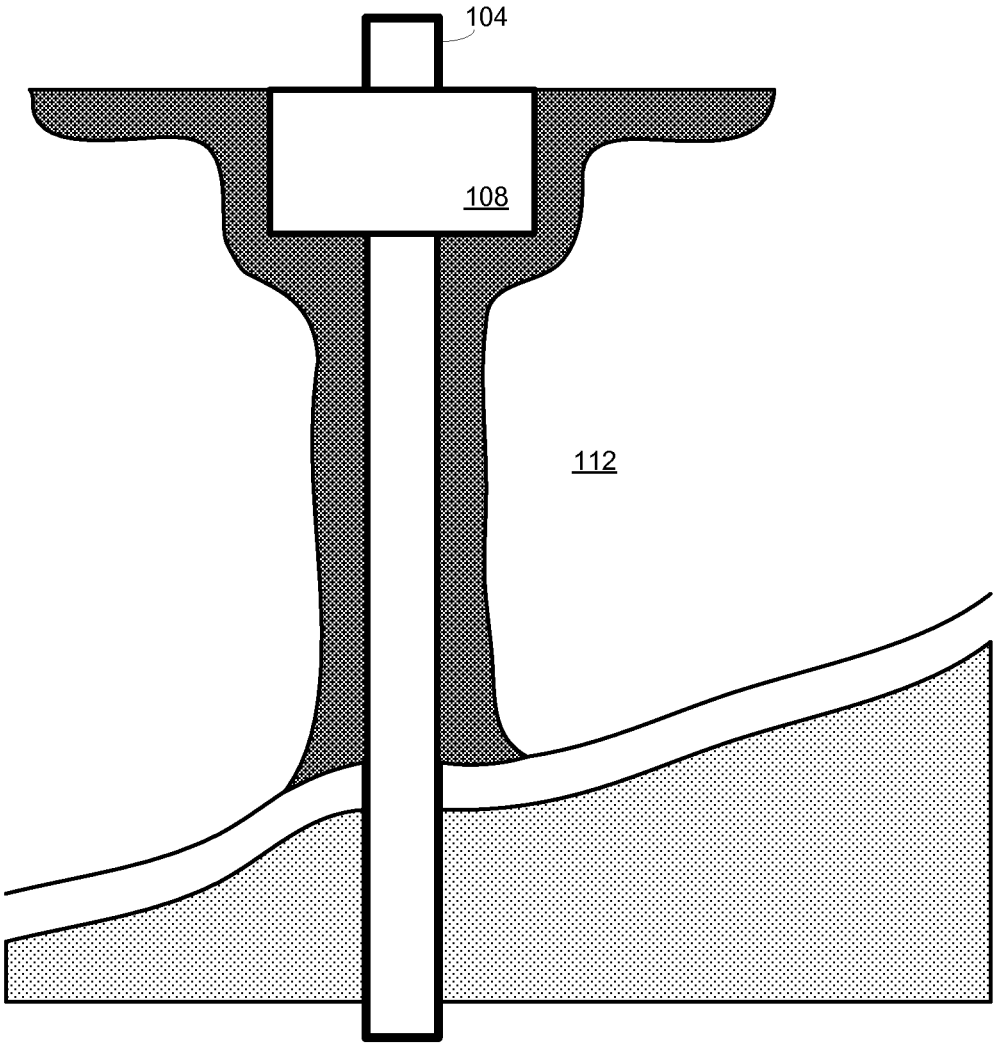
FIG. 1 provides a schematic illustration of an oil-drilling site.

Embodiments of the invention provide methods and apparatus for containment of oil resulting from leaks at oil drilling sites. The methods and apparatus of the invention find application at all stages of oil-production processes, including drilling, production, and completion. A general overview is provided with FIG. 1, which provides a schematic illustration of an oil drilling site. At the site, a conductor pipe 104 is installed at or near the surface of the ground 112, which may include different structures at different depths as illustrated generically in the drawing. As used herein, the "conductor pipe" is used broadly to refer to any tubular member installed at or near the ground surface, including conductor pipes, riser pipes, surface casings, and the like.

Disposed at least partially beneath the surface of the ground, and in some embodiments disposed entirely beneath the surface of the ground, resides a containment cellar 108 made in accordance with embodiments of the invention. The containment cellar 108 may be placed at an excavation site that at least partially surrounds a portion of the conductor pipe 104. To emphasize that there is a wide variety of oil-drilling rigs with which the invention may be used, further specific details of the rig itself are omitted from FIG. 1. In this regard, it is to be understood that the invention is not limited by the particular form of the rig and may find utility with various types of rigs.

Generally, the containment cellar 108 is made of a material that has sufficient strength to provide structural support that resists collapse of the surrounding earth into a cavity defined by the structure of the containment cellar 108. Examples of suitable materials include iron, steel, and other metals, as well as a variety of strong, nonmetallic materials like Plexiglas, hard plastic, and the like. The containment cellar 108 may also be composed of multiple pieces that are joined by such techniques as welding, bolting, and the like, depending on such factors as the specific structure of the containment cellar, its material(s) of composition, etc. In embodiments where multiple pieces are joined together, materials that are substantially impermeable to petroleum substances may be disposed between joints. Suitable materials include gasket material, RP silicone, and the like.

Figure 2A:
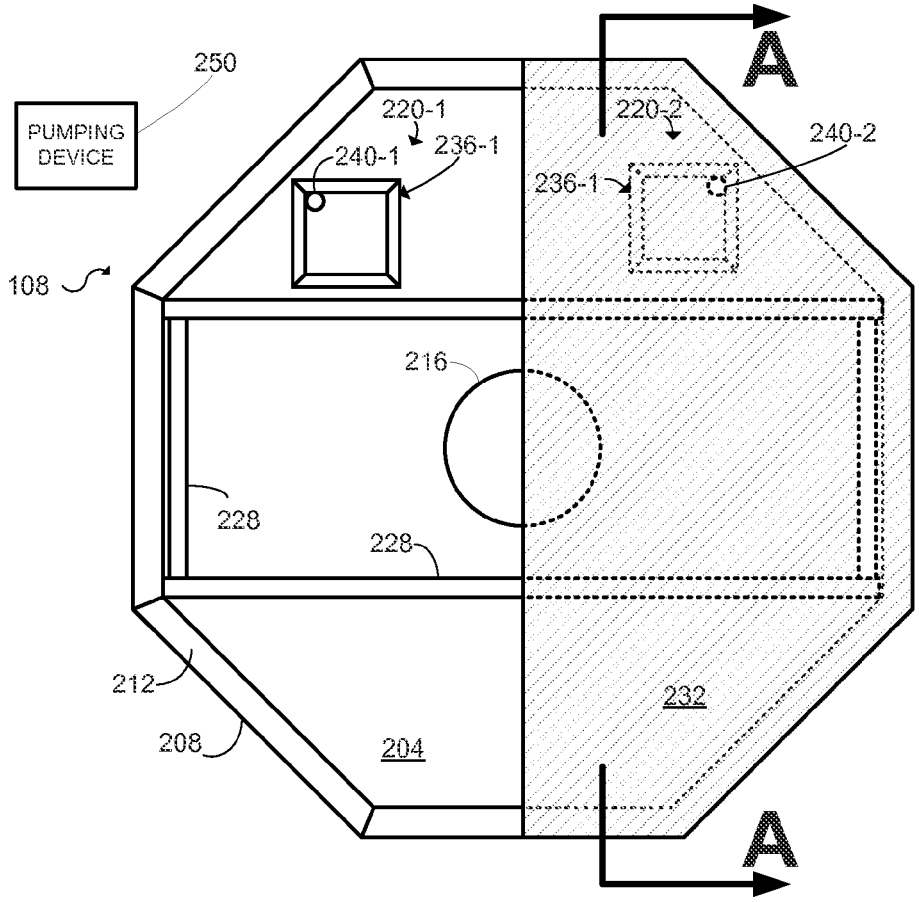
FIGS. 2A-2D provide views of a containment cellar according to an embodiment of the invention.
Figure 2B:
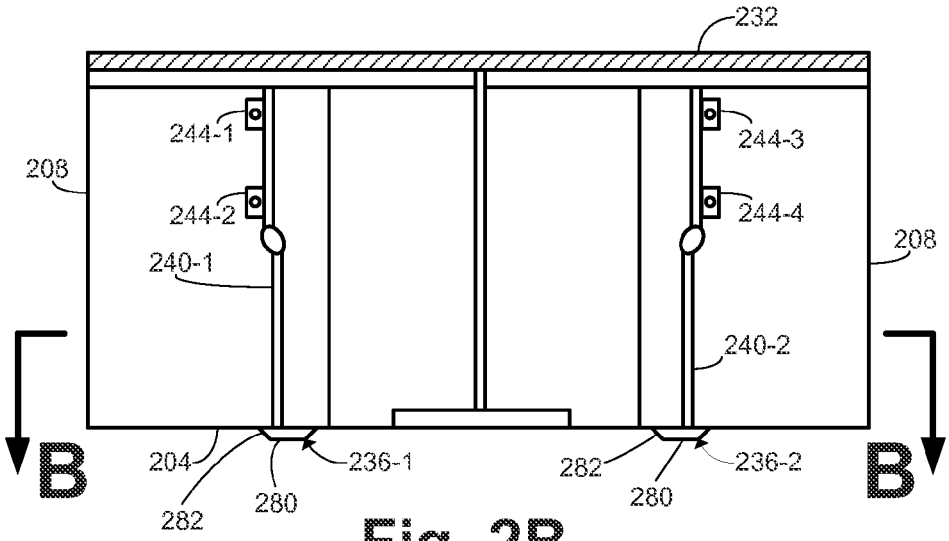
Figure 2C:
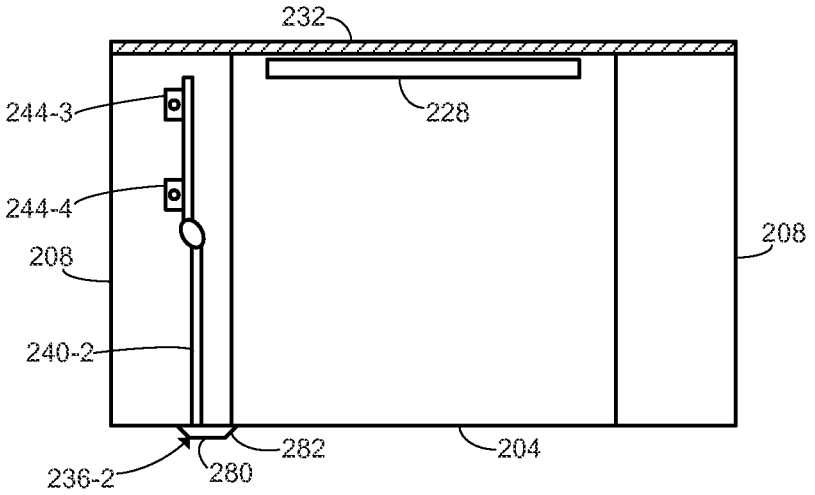
Figure 2D:
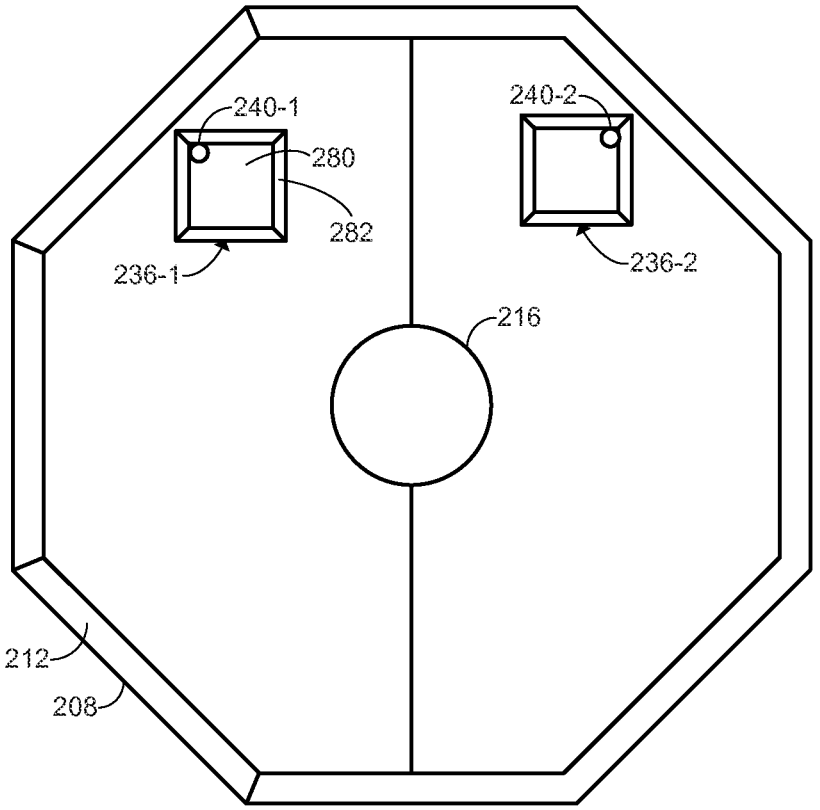

One specific structure for the containment cellar 108 in an embodiment is shown with FIGS. 2A-2D, in which FIG. 2A provides a top view of the containment cellar 108, FIG. 2B shows a front view of the containment cellar 108, FIG. 2C shows a cross-sectional view along section A-A of FIG. 2A, and FIG. 2D shows a cross-sectional view along section B-B of FIG. 2B. In FIG. 2A, a portion of the grating 232 has been cutaway on the left of the drawing to better show interior features of the containment cellar 108, but the grating 232 may more generally extend substantially over the entire top of the containment cellar 108, as shown explicitly in other views.

The containment cellar 108 defines an interior space bounded by the grating 232, side walls 208, and bottom 204. In some embodiments, the side walls 208 may comprise stiffeners 212 to provide greater strength to the structure. While the structure shown in the drawings has a generally octagonal shape, this is not intended to be limiting. More generally, the containment cellar 108 may have any arbitrary shape, including square, rectangular, circular, elliptical, and any variety of regular or irregular polygonal shapes. Further structural support to the structure may be provided with ribs 228, which may be provided as angles in some embodiments. Notably, the presence of such ribs 228 may provide support to the grating 232 to accommodate the presence or weight.

A through-hole 216 is shown disposed in the center of the containment cellar 108, but this is also not intended to be limiting, and may more generally be disposed at any location within the interior of the side walls 208. The function of the through-hole 216 is to receive the conductor pipe 108 when the containment cellar 108 is disposed in position as shown in FIG. 1.

The bottom 204 of the containment cellar 108 also take a number of different configurations in different embodiments. In the embodiment shown in the drawings, the bottom 204 is substantially flat except for one or more wells 236 disposed to collect petroleum substances that leak into the containment cellar 108. In other embodiments, the bottom 204 is shaped with slopes for more efficient direction of leaked petroleum substances.

The structure of the containment cellar 108 may also accommodate one or more pumping orifices 220, such as pumping orifices 220-1, 220-2, which are configured for coupling with a pumping device 250 to extract collected petroleum substances from the cellar 108. In the illustrated embodiment, each pumping orifice 220 includes a pipe 240, such as pipes 240-1, 240-2, that extends from a top of the interior chamber of the containment cellar 108 to a respective well 236, such as wells 236-1, 236-2, so that petroleum products are pumped from the well, resulting in more efficient removal of collected petroleum substances from the containment cellar 108. As shown, each well 236 includes a lower wall 280 positioned below the bottom 204 and at least one side wall 282 connecting the lower wall 280 to the bottom 204. In this regard, each respective pipe 240 may extend from a respective one of the wells 236 through the interior space to a top of the interior space and is adapted for coupling with a pump (e.g., pumping device 250) to extract the collected petroleum substances from the respective well 236 and out of the interior space. The pipes 240 may take a variety of shapes and sizes depending on the size and shape of the cellar 108 itself and perhaps also depending on an anticipated frequency or volume of petroleum substance to be removed from the containment cellar 108. The pipes 240 may include jogs as shown in the drawing, but this is also not a necessary feature of the invention. The pipes 240 are mounted with mounting plates 244, such as mounting plates 244-1, 244-2, 244-3, 244-4, where each mounting plate 244 secures a respective one of the plurality of pipes 240 to the cellar 108.

In some embodiments, the containment cellar 108 may include a fluid-level sensor installed to monitor the level of petroleum substances, triggering an alarm when a predetermined level is reached so that pumping operations via the pumping orifice(s) may be initiated.

Figure 3:
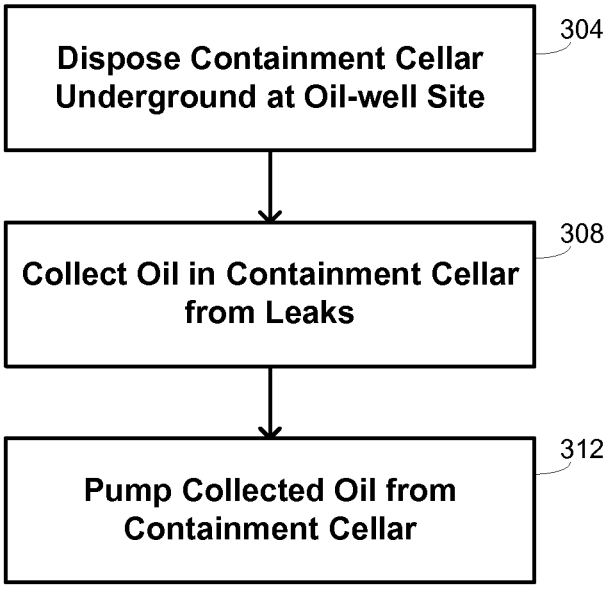
FIG. 3 is a flow diagram summarizing methods of the invention.

Methods of the invention are summarized with the flow diagram of FIG. 3. At block 304, the containment cellar 108 is disposed at least partially underground at an oil-well site. During oil-extraction procedures, oil from leaks is collected in the containment cellar 108 at block 308, so that collected oil may be pumped from the containment cellar 108 at block 312.

Having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed:

1. A system, comprising: a conductor pipe installed near a surface of the earth at an oil drilling site for use in extracting petroleum products from beneath the surface of the earth; and a containment cellar for collecting petroleum products leaked in a vicinity of the conductor pipe, the containment cellar comprising:

a body comprising a bottom surface, a plurality of wells formed within the bottom surface, an aperture through the bottom surface to receive the conductor pipe, and a side surface to define an interior chamber to surround the conductor pipe, wherein:

each well is defined by a lower wall disposed below the bottom surface and at least one side wall connecting the lower wall to the bottom surface;

the bottom and side surfaces are composed of materials substantially impermeable to the petroleum products; and the side surface is composed of a material having sufficient strength to maintain integrity of the interior chamber when the containment cellar is disposed at least partially beneath the surface of the earth;

a plurality of petroleum product removal pipes, wherein each pipe extends from a respective one of the plurality of wells through the interior chamber to a top of the interior chamber and is adapted for coupling with a pump to extract the leaked petroleum products from the respective well and out of the interior chamber; and a plurality of mounting brackets, wherein each mounting bracket secures a respective one of the plurality of petroleum product removal pipes to the body.

2. The system recited in claim 1, wherein the containment cellar further comprises a grating disposed at the top of the interior chamber opposite the bottom surface.

3. The system recited in claim 1, wherein the containment cellar further comprises a reinforcing member disposed within the interior chamber.

4. The system recited in claim 1 wherein the bottom and side surfaces are made of metal.

5. The system recited in claim 1 wherein the bottom and side surfaces are made of a hard plastic.

6. The system recited in claim 1 wherein the side surface comprises a plurality of side surfaces joined such that the interior chamber has a polygonal cross section.

7. The system recited in claim 1 wherein the bottom surface comprises a plurality of pieces, wherein the pieces are joined with an material substantially impermeable to the petroleum products between the pieces.

8. The system recited in claim 1, wherein the plurality of wells includes first and second wells, and wherein the lower wall of the first well is spaced from the lower wall of the second well.

9. A method for collecting petroleum products leaked in a vicinity of a conductor pipe at an oil drilling site, the method comprising:

receiving a conductor pipe through an aperture in a bottom surface of a containment cellar so that an interior chamber of the containment cellar surrounds the conductor pipe, wherein the interior chamber of the containment cellar is defined by the bottom surface and a side surface, wherein the bottom and side surface are composed of materials that are substantially impermeable to petroleum products, and wherein the conductor pipe is installed near a surface of the earth at an oil drilling site for use in extracting petroleum products from beneath the surface of the earth;

disposing the containment cellar at least partially beneath a surface of the earth, wherein the side surface is composed of a material having sufficient strength to provide structural support to resist collapse of the earth into the interior chamber;

collecting petroleum products from the conductor pipe in the interior chamber within a plurality of wells formed within the bottom surface, wherein each well is defined by a lower wall disposed below the bottom surface and at least one side wall connecting the lower wall to the bottom surface; and pumping the collected petroleum products from the interior chamber, wherein the pumping step includes:

coupling a pump to a pipe that extends from one of the plurality of wells through the interior chamber to a top of the interior chamber; and operating the pump to pump the collected petroleum products from the one of the plurality of wells through the pipe and remove the collected petroleum products from the interior chamber of the containment cellar.

10. The method recited in claim 9 wherein the containment cellar further comprises a grating disposed at the top of the interior chamber opposite the bottom surface.

11. The method recited in claim 9 wherein the bottom and side surfaces are made of metal.

12. The method recited in claim 9 wherein the bottom and side surfaces are made of a hard plastic.

13. The method recited in claim 9, wherein the pumping step further includes:

coupling the pump to another pipe that extends from another of the plurality of wells through the interior chamber to a top of the interior chamber; and operating the pump to pump the collected petroleum products from the other of the plurality of wells through the other pipe and remove the collected petroleum products from the interior chamber of the containment cellar.

* * * * *